US007778568B2

(12) United States Patent
Sakashita et al.

(10) Patent No.: US 7,778,568 B2
(45) Date of Patent: Aug. 17, 2010

(54) IMAGE FORMING APPARATUS HAVING GUIDE MEMBER FOR DETACHABLE UNIT

(75) Inventors: Takeshi Sakashita, Osaka (JP); Tomofumi Inoue, Osaka (JP); Takeru Muramatsu, Ibaraki (JP); Kohji Hatayama, Osaka (JP); Yuuji Meguro, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 311 days.

(21) Appl. No.: 11/746,258

(22) Filed: May 9, 2007

(65) Prior Publication Data

US 2007/0269233 A1 Nov. 22, 2007

(30) Foreign Application Priority Data

May 19, 2006 (JP) ..... 2006-140103

(51) Int. Cl.
*G03G 15/00* (2006.01)

(52) U.S. Cl. ..... 399/110; 399/316; 399/358

(58) Field of Classification Search ..... 399/114, 399/121, 123
See application file for complete search history.

(56) References Cited

U.S. PATENT DOCUMENTS 5,115,272 A * 5/1992 Ohmori et al. ..... 399/110
6,035,158 A * 3/2000 Asakura et al. ..... 399/101
2006/0083559 A1* 4/2006 Yoo et al. ..... 399/316

FOREIGN PATENT DOCUMENTS

| | | |
|---|---|---|
| JP | 5-147753 | 6/1993 |
| JP | 7-230197 | 8/1995 |
| JP | 8-202241 | 8/1996 |
| JP | 2004-302018 | 10/2004 |

OTHER PUBLICATIONS

U.S. Appl. No. 11/747,542, filed May 11, 2007, Sakashita et al.
U.S. Appl. No. 12/125,653, filed May 22, 2008, Inoue et al.

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An image forming apparatus includes a carrier unit including an intermediate transfer member, a detachable waste toner container, and a recording-medium directing member provided to the carrier unit. The recording-medium directing member guides a recording medium, and also prevents the waste toner container from contacting the intermediate transfer member when the waste toner container is attached to or detached from the image forming apparatus.

18 Claims, 7 Drawing Sheets

IMAGE FORMING APPARATUS HAVING GUIDE MEMBER FOR DETACHABLE UNIT

CROSS-REFERENCE TO RELATED APPLICATIONS

The present document incorporates by reference the entire contents of Japanese priority document, 2006-140103 filed in Japan on May 19, 2006.

BACKGROUND OF THE INVENTION

1. Field of the Invention

The present invention relates to an image forming apparatus.

2. Description of the Related Art

An image forming apparatus including an image carrier and a detachable unit has been known. For example, Japanese Patent Application Laid-Open No. 7-230197 discloses such a conventional image forming apparatus. The image carrier is configured as, for example, a photosensitive member or an intermediate transfer member on which a toner image is transferred from the photosensitive member. In the image forming apparatus of this type, if a detachable unit inside the image forming apparatus is located near the image carrier, the detachable unit may bump against the surface of the image carrier when attached or detached, thereby making a scratch on a surface of the image carrier. Such a scratch on the surface of the image carrier will cause deterioration in the quality of a toner image transferred on a recording medium.

To overcome this problem, a protective member can be provided that prevents the contact of the detachable unit with the image carrier when the detachable unit is attached or detached. With this, the detachable unit can be prevented from bumping against the surface of the image carrier when attached or detached, and the above inconvenience can be eliminated. This configuration, however, requires an additional protective member for image carrier, thereby increasing the number of components of the image forming apparatus and resulting in cost increase.

SUMMARY OF THE INVENTION

It is an object of the present invention to at least partially solve the problems in the conventional technology.

According to an aspect of the present invention, an image forming apparatus includes a carrier unit that includes an image carrier that carries a toner image and a frame that supports the image carrier, a transferring unit that transfers the toner image from the image carrier onto a recording medium, and a detachable unit that is detachably mounted on an apparatus body and located near the image carrier. The carrier unit further includes a first guide member that guides the recording medium as well as preventing the detachable unit from contacting the image carrier when the detachable unit is attached or detached.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below.

Figure 1:
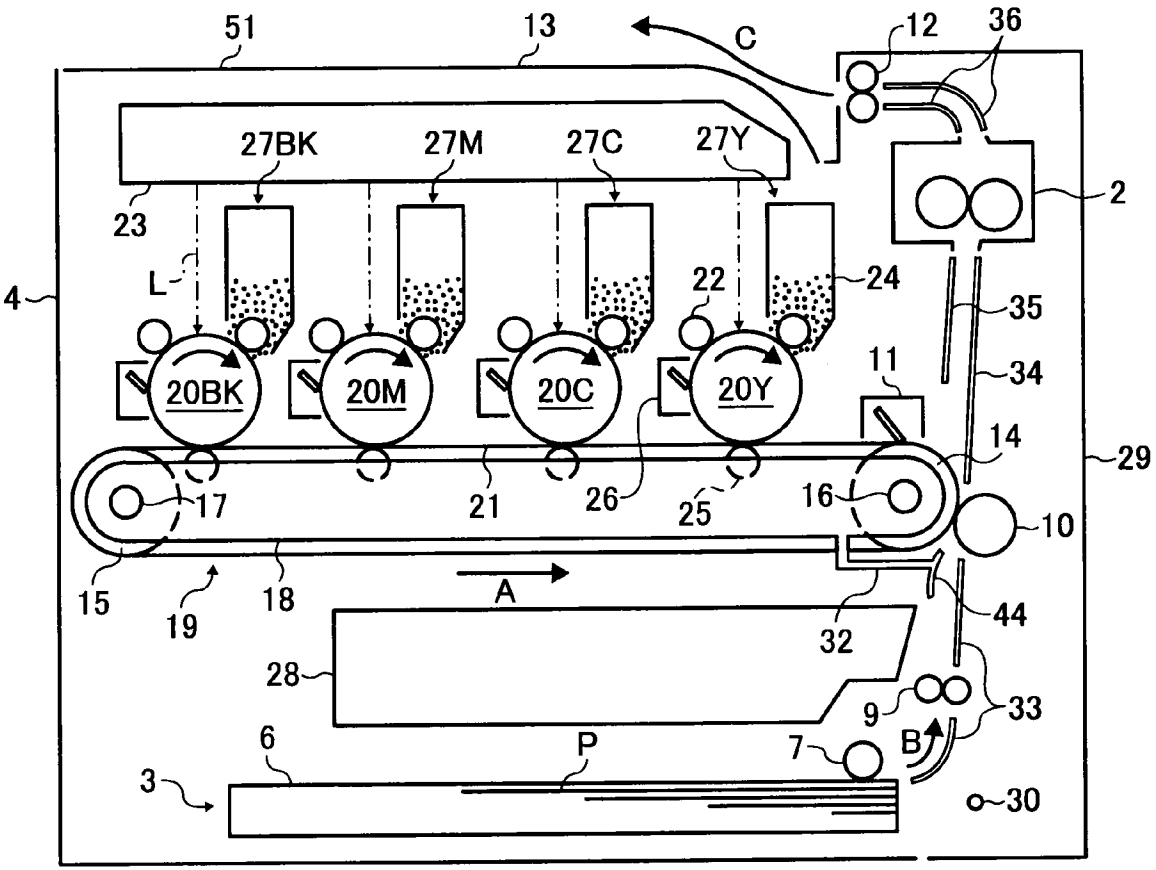
FIG. 1 is a schematic diagram of an image forming apparatus according to an embodiment of the present invention.

FIG. 1 is a schematic diagram of an image forming apparatus according to an embodiment of the present invention. The image forming apparatus includes an apparatus body 4, and inside the apparatus body 4, photosensitive members 20Y, 20C, 20M, and 20BK having a drum shape. The image forming apparatus further includes an intermediate transfer member 21 formed of an endless belt. The intermediate transfer member 21 extends around a plurality of supporting rollers 14 and 15, and faces the photosensitive members 20Y, 20C, 20M, and 20BK. Each of the photosensitive members 20Y, 20C, 20M, and 20BK is driven for rotation in a clockwise direction in FIG. 1. With rotation of one of the supporting rollers 14 and 15 being driven, the intermediate transfer member 21 is rotated in a direction indicated by an arrow A. At this time, the photosensitive member 20Y is charged by a charging roller 22 with a predetermined polarity.

From an optical writing unit 23, an optically-modulated laser beam L is emitted, and a charging surface of the photosensitive member 20Y is radiated with the laser beam L. With this, an electrostatic latent image is formed on the photosensitive member 20Y. This electrostatic latent image is then visualized by a developing device 24 as a toner image.

A transfer voltage is applied to a primary transfer roller 25, so that the toner image formed on the photosensitive member 20Y is primarily transferred onto the intermediate transfer member 21 rotating in the arrow A direction. A residual transfer toner attached on the photosensitive member 20Y after toner image transfer is removed by a cleaning device 26.

In a manner similar to that explained above, a cyan toner image, a magenta toner image, and a black toner image are formed onto the photosensitive members 20C, 20M, and 20BK, respectively. These toner images are primarily transferred onto the intermediate transfer member 21, and sequentially superposed onto the yellow toner image transferred thereon. In this manner, the toner images are carried on the intermediate transfer member 21. The intermediate transfer member 21 serves as an example of an image carrier that carries a toner image.

A sheet feeding device 3 is arranged at a lower portion of the apparatus body 4. The sheet feeding device includes a sheet feeding tray 6 having accommodated therein recording media P such as transfer sheets or resin films, and a sheet feeding roller 7 in contact with the recording medium P at the top. With the rotation of the sheet feeding roller 7, the recording medium P at the top is sent in a direction indicated by an arrow B. The sent recording medium is fed to a position between the intermediate transfer member 21 and a secondary transfer roller 10 facing thereto at a predetermined timing by the rotation of paired resist rollers 9. At this time, a transfer voltage is applied to the secondary transfer roller 10. With this, the superposed toner image on the intermediate transfer member 21 is secondarily transferred onto the recording medium. As just described, the secondary transfer roller 10 serves as an example of a transferring unit that transfers a toner image from the image carrier onto the recording medium. A residual transfer toner attached on the intermediate transfer member 21 after toner image transfer is removed by a cleaning device 11 for belt.

The recording medium having transferred thereon the toner image then passes through a fixing device 2. At this time, by the action of heat and pressure, the toner image on the recording medium is fixed onto the recording medium. The recording medium passing through the fixing device 2 is delivered by paired delivery rollers 12 onto a delivering unit 13 as indicated by an arrow C. The recording medium conveyed from the sheet feeding device 3 to the delivering unit 13 is guided by a recording-medium directing surface 44 of a recording-medium directing member 32 positioned at a lower portion of the intermediate transfer member 21, and other guide plates 33, 34, 35, and 36.

The image forming apparatus further includes process cartridges 27Y, 27C, 27M, and 27BK that are detachable from the apparatus body 4. Each of the process cartridges 27Y, 27C, 27M, and 27BK includes corresponding one of the photosensitive members 20Y, 20M, 20C and 20BK shown in FIG. 1, and corresponding one of the charging rollers 22, the developing devices 24, and the cleaning devices 26 surrounding the photosensitive members 20Y, 20M, 20C and 20BK.

The supporting rollers 14 and 15 have center shafts 16 and 17, respectively, which are rotatably supported by a frame 18 shown in FIG. 1. The frame 18 is supported so as to be accurately positioned with respect to the apparatus body 4. In this manner, the intermediate transfer member 21 is rotatably supported via the supporting rollers 14 and 15 by the frame 18, thereby configuring an image carrier formed of the intermediate transfer member 21 that carries a toner image and a carrier unit 19 having the frame 18 that supports the image carrier. The carrier unit 19 is supported to be positioned with respect to the apparatus body 4.

As shown in FIG. 1, a waste toner container 28 is arranged below the carrier unit 19 as an example of a detachable unit. To the waste toner container 28, a waste toner removed from each of the photosensitive members 20Y, 20M, 20C, and 20BK, a waste toner removed from the intermediate transfer member 21, or all of these toners are conveyed via a pipe (not shown) to be accommodated in the waste toner container 28. The detachable unit configured as the waste toner container 28 is detachably mounted inside the apparatus body 4 as explained below. When the detachable unit is mounted inside the apparatus body 4, the detachable unit is positioned near the image carrier formed of the intermediate transfer member 21 explained above.

Figure 2:
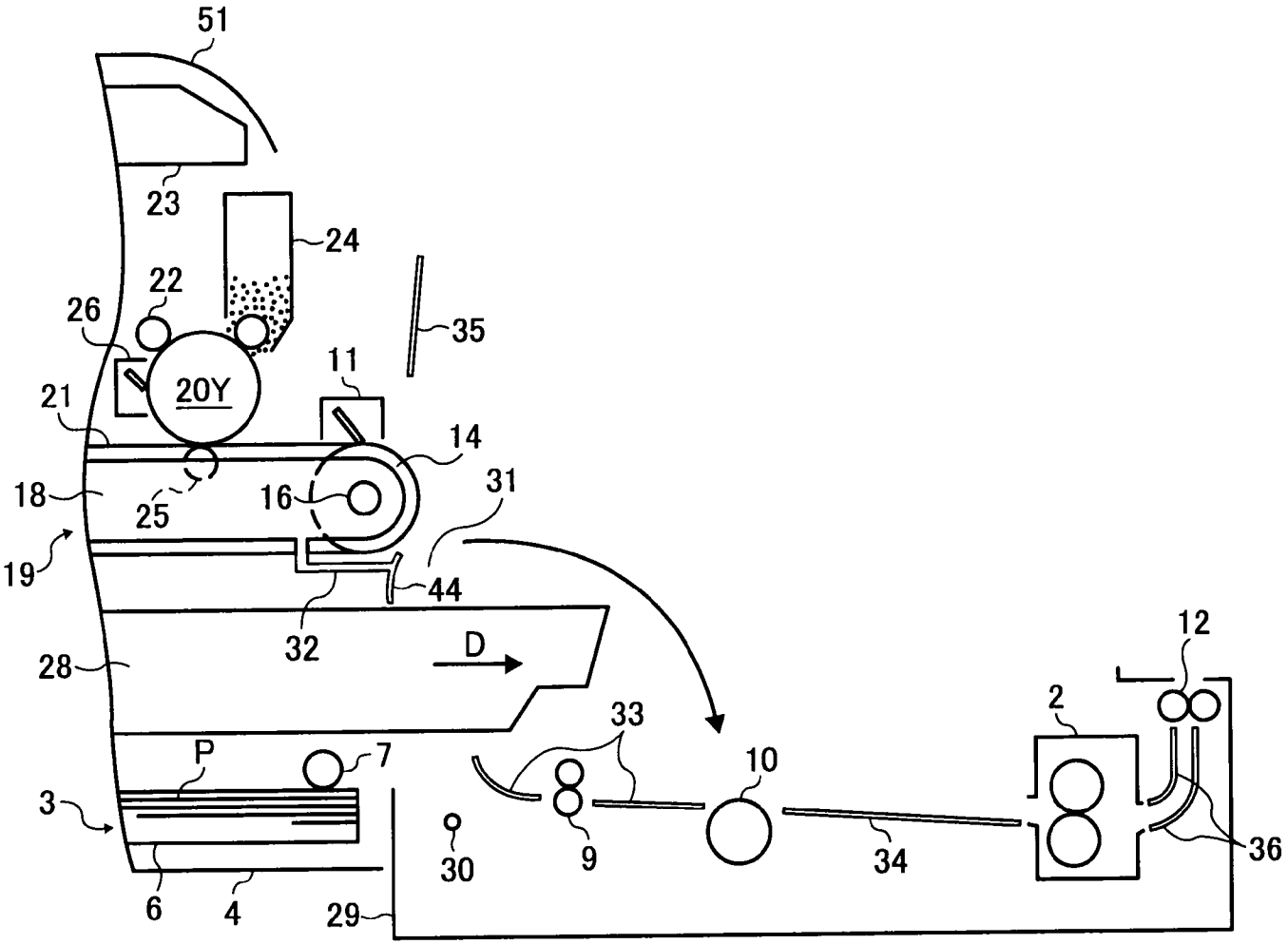
FIG. 2 is a schematic diagram of the image forming apparatus when an open/close member is opened.

A user normally operates the image forming apparatus from the right side of the image forming apparatus in FIG. 1. Accordingly, the right side of the apparatus body 4 in FIG. 1 is defined herein as a front side thereof. On the front side of the apparatus body 4, an open/close member 29 is supported by a pivot pin 30 at a lower portion of the apparatus body 4 so as to be rotatably opened and closed. When the user positioned on the front side of the apparatus body 4 holds an upper portion of the open/close member 29 and then pulls it toward the user, the open/close member 29 rotates about the pivot pin 30 as shown in FIG. 2, thereby providing an opening 31 on the front side of the apparatus body 4. As can be seen from FIG. 2, the secondary transfer roller 10, the paired resist rollers 9, the fixing device 2, the sheet feeding roller, and the guide plates 33, 34, and 36 are supported by the open/close member 29.

When the waste toner container 28 is full of waste toner and is replaced by a vacant waste toner container, the open/close member 29 is opened as shown in FIG. 2. Through the opening 31 of the apparatus body 4, the waste toner container 28 is pulled toward the front side as depicted with an arrow D. At this time, the waste toner container 28 moves as being guided by a guide rail (not shown). Conversely, by pressing the waste toner container 28 in a direction opposite to the arrow D, the waste toner container 28 is accommodated inside the apparatus body 4 as shown in FIG. 1 at a predetermined mounting position, and the open/close member 29 is closed. In this manner, the image forming apparatus of this embodiment is configured such that the waste toner container 28, as an example of the detachable unit, is attached to or detached from the apparatus body 4 through the opening 31 provided by the opening of the open/close member 29.

The image forming apparatus of this embodiment is configured such that the optical writing unit 23, the process cartridges 27Y, 27M, 27C, and 27BK, the carrier unit 19, and the waste toner container 28 are sequentially disposed from top to bottom inside the apparatus body 4. With the open/close member 29 being opened, not only the waste toner container 28 but also the process cartridges 27Y, 27M, 27C, and 27BK and the carrier unit 19 can be attached or detached. Also, at an upper portion of the apparatus body, as shown in FIG. 1, a top cover 51 is supported so as to be rotatably opened or closed about a back side (left side in FIG. 1). The top cover 51 has mounted thereon the optical writing unit 23. With the top cover 51 being rotated in a counterclockwise direction in FIG. 1, the optical writing unit 23 can be taken out to the outside of the apparatus body. Furthermore, the process cartridges 27Y, 27M, 27C, and 27BK can be drawn out upward.

Meanwhile, as explained above, when the waste toner container 28 is mounted inside the apparatus body 4, the waste toner container 28 is positioned near the intermediate transfer member 21. In particular, recent image forming apparatuses have been further downsized so as to have the components in the apparatus body 4 disposed closely to one another, and therefore the intermediate transfer member 21 and the waste toner container 28 may often be disposed extremely closely to each other. For this reason, when the waste toner container 28 is attached to or detached from the apparatus body 4, the waste toner container 28 may bump against the intermediate transfer member 21 to make a scratch on the surface of the intermediate transfer member 21. To get around this problem, if a protective member is provided that inhibits the contact of the waste toner container 28 with the intermediate transfer member 21 when the waste toner container 28 is attached or detached, as explained above, the number of components of the image forming apparatus is increased, which increases cost.

To get around such an increase, in a modification of the image forming apparatus, the recording-medium directing member 32 explained above is provided between the carrier unit 19 and the waste toner container 28. The recording-medium directing member 32 also serves as a protective member that inhibits the contact of the waste toner container 28 with the image carrier formed of the intermediate transfer member 21 when the detachable unit formed of the waste toner container 28 is attached to or detached from the apparatus body 4. The recording-medium directing member 32 is provided to the carrier unit 19. In the image forming apparatus shown in FIG. 1, the recording-medium directing member 32 is integrally formed with the frame 18 of the carrier unit 19. As explained further below, the recording-medium directing member 32 can be rotatably coupled to the frame 18 so that the recording-medium directing member 32 is attached to the carrier unit 19.

As explained above, when the open/close member 29 is opened to remove the waste toner container 28, the recording-medium directing member 32 is positioned between the waste toner container 28 and the intermediate transfer member 21. Therefore, even if the waste toner container 28 bumps against the recording-medium directing member 32, the waste toner container 28 can be inhibited from abutting on the intermediate transfer member 21. This can inhibit an inconvenience such that a scratch is made on the surface of the intermediate transfer member 21 to deteriorate the image quality of the image transferred onto the recording medium. At the time of an image forming operation, the recording-medium directing surface 44 of the recording-medium directing member 32 can guide the recording medium without problems. In this manner, the carrier unit includes the recording-medium directing member also serving as a protective member that prevents the detachable unit from contacting the image carrier when the detachable unit is attached or detached. This simplifies the configuration of the image forming apparatus, suppresses an increase in cost, and also prevents the detachable unit from contacting the image carrier when the detachable unit is attached or detached.

Figure 3:
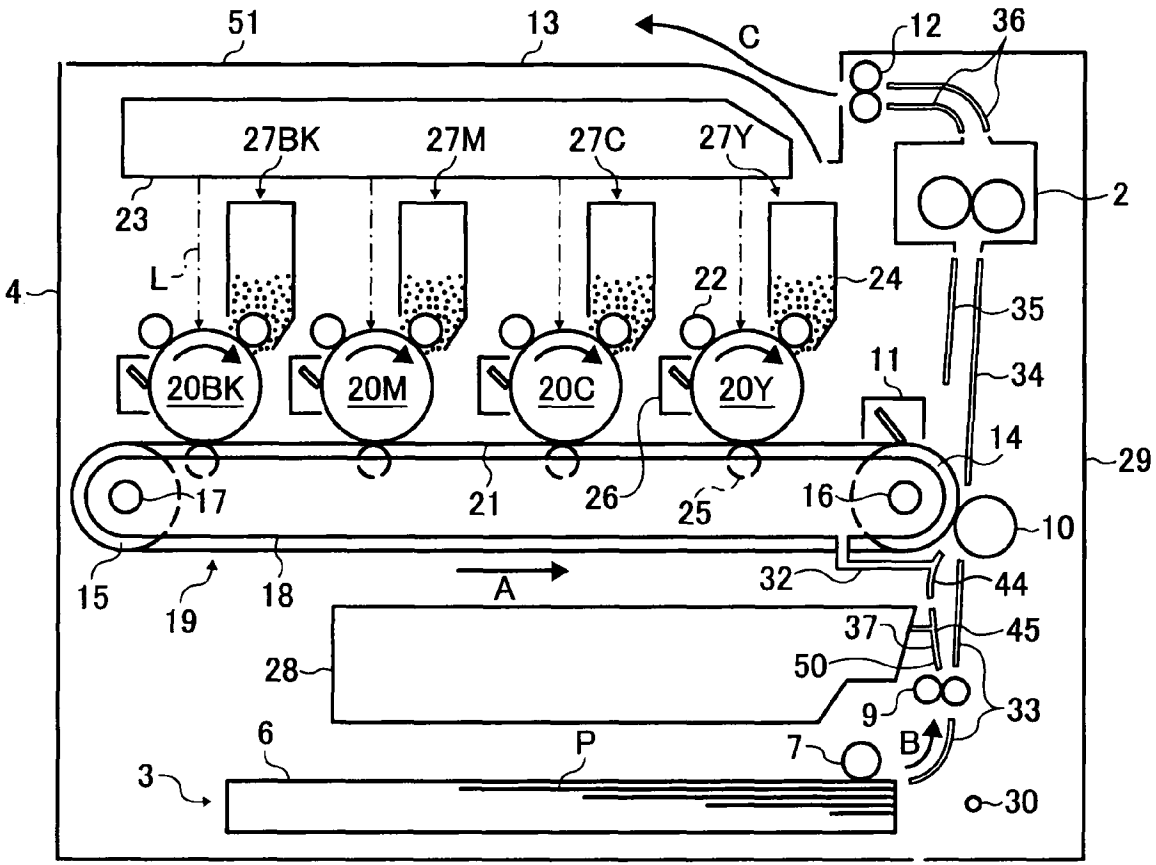
FIG. 3 is a modification of the image forming apparatus that includes a recording-medium guide member fixed to a waste toner container.
Figure 7:
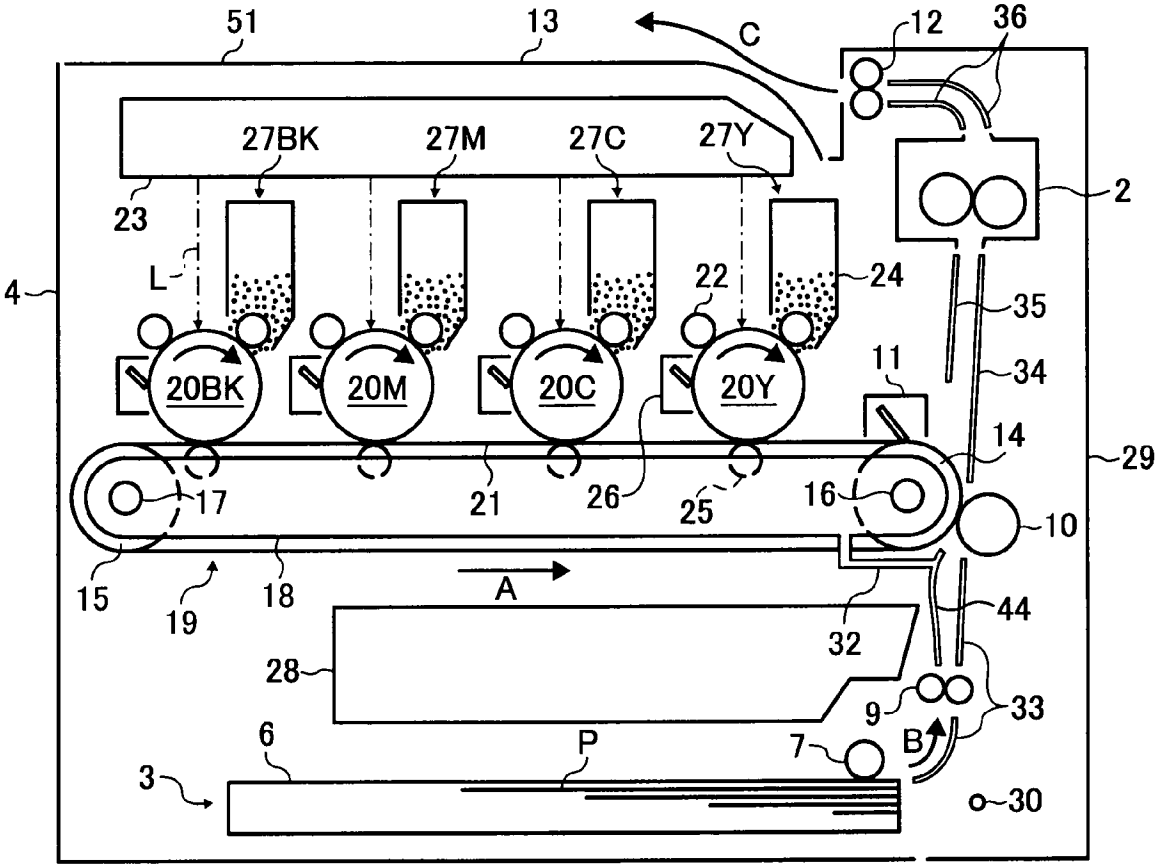
FIG. 7 is a schematic diagram for explaining inconvenience caused when the recording-medium directing member extends far downward.

Meanwhile, if the recording-medium directing member 32 mentioned above extends far downward as shown in FIG. 7 so as to reliably guide the recording medium moving through a conveyance route on an upstream side in a recording-medium conveying direction, a lower portion of the recording-medium directing member 32 will be positioned in a attachment/detachment route of the waste toner container 28. Therefore, the waste toner container 28 may bump against the recording-medium directing member 32 when attached or detached, and the waste toner container 28 cannot be attached or detached. In such a case, as shown in FIG. 3, it is preferable that a recording-medium guide member 37 adjacent to the recording-medium directing member 32 and positioned in the attachment/detachment route of the detachable unit formed of the waste toner container 28 be provided to the waste toner container 28. The recording-medium guide member 37 is provided to the detachable unit by, for example, being integrally fixed to the detachable unit formed of the waste toner container 28. With this configuration, the recording medium can be guided also by a recording-medium directing surface 45 of the recording-medium guide member 37 at the time of an image forming operation. Also, when the detachable unit is attached or detached, the recording-medium guide member 37 can also attached or detached together. Therefore, although the recording-medium guide member 37 is positioned in the attachment/detachment route of the detachable unit, the recording-medium guide member 37 does not obstruct the detachable or mounting of the detachable unit. Otherwise, the image forming apparatus shown in FIG. 3 has basically the same configuration as that of the image forming apparatus shown in FIGS. 1 and 2.

In the image forming apparatus shown in FIGS. 1 to 3, the recording-medium directing member 32 is fixed to the frame 18 of the carrier unit 19. Alternatively, as shown in FIG. 4B, the configuration can be such that, when the waste toner container 28 is moved from a predetermined mounting position inside the apparatus body 4, the recording-medium directing member 32 covers a front 38 of the intermediate transfer member 21 directed toward the opening 31 (FIG. 2) of the opened apparatus body 4. A specific configuration of such an image forming apparatus is as follows.

Figure 4A:
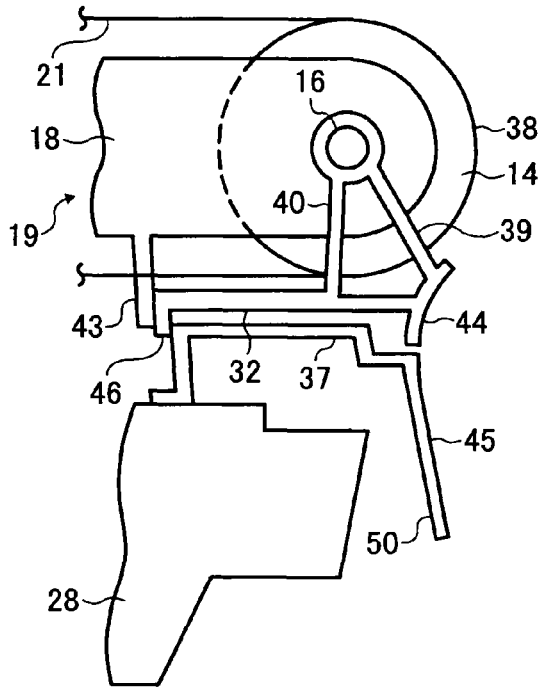
FIGS. 4A and 4B are schematic diagrams for explaining the operation of a recording-medium directing member that is adjusted together with attachment/detachment of the waste toner container.
Figure 4B:
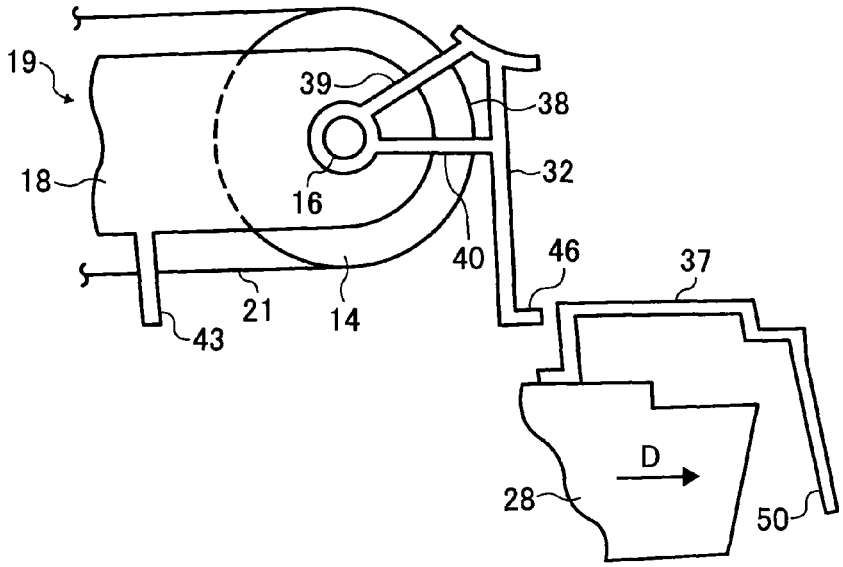

As shown in FIGS. 4A and 4B, the center shaft 16 of the supporting roller 14 has bases of integrally-formed two arms 39 and 40 rotatably supported, and the recording-medium directing member 32 is fixed at the tips of both the arms 39 and 40. Also, the arms 39 and 40 are pressed for rotation by a spring (not shown) from a position shown in FIG. 4A to a position shown in FIG. 4B.

FIG. 4A depicts the state in which the waste toner container 28 is accommodated inside the apparatus body 4 at a predetermined mounting position. At this time, the recording-medium guide member 37 fixed by the waste toner container 28 presses the recording-medium directing member 32. With this, a lower portion 46 of the recording-medium directing member 32 makes a press-contact with a stopper portion 43 integrally fixed to the frame 18. In this manner, at the time of an image forming operation, the recording-medium directing surface 44 of the recording-medium directing member and the recording-medium directing surface 45 of the recording-medium guide member 37 can reliably guide the recording medium. The position of the recording-medium directing member 32 at this time is a recording-medium directing position allowing the recording medium to be guided.

Here, when the open/close member 29 is opened as shown in FIG. 2 to move the waste toner container 28 from a predetermined mounting position inside the apparatus body 4 to the arrow D direction, the pressure action by the recording-medium guide member 37 onto the recording-medium directing member 32 is gradually released and, eventually, the recording-medium guide member 37 is separated from the recording-medium directing member 32. With this, the recording-medium directing member 32 is moved for rotation in a counterclockwise direction in FIG. 4A about the center shaft 16 by the action of the spring mentioned above. In this manner, as shown in FIG. 4B, the recording-medium directing member 32 occupies a covering position at which the front 38 of the intermediate transfer member 21 is covered, and is fixed at this position by a stopper (not shown). At this time, the lower portion 46 of the recording-medium directing member 32 is positioned between the intermediate transfer member 21 and the waste toner container 28. Therefore, when the waste toner container 28 is moving, the waste toner container 28 is prevented from making contact with the intermediate transfer member 21. Thus, the recording-medium directing member 32 can serve as a protective member without problems. Furthermore, since the waste toner container 28 covers the front 38 of the intermediate transfer member 21, the user can be prevented from erroneously touching the surface of the intermediate transfer member 21 by hand.

When the waste toner container 28 is pressed in a back direction opposite to the arrow D, the recording-medium guide member 37 bumps against the lower portion 46 of the recording-medium directing member 32 and presses it in the back direction. Therefore, the recording-medium directing member 32 is moved in a clockwise direction in FIG. 4B against the action of the spring mentioned above, and eventually stops as abutting on the stopper portion 43, as shown in FIG. 4A. In this manner, the recording-medium directing member 32 is returned to the recording-medium directing position separated from the covering position at which the front 38 of the intermediate transfer member 21 is covered.

As shown in FIG. 1, if no recording-medium guide member is fixed to the waste toner container 28, when the waste toner container 28 is mounted, the waste toner container itself presses the recording-medium directing member 32 shown in FIGS. 4A and 4B to move the recording-medium directing member 32 to the recording-medium directing position. Otherwise, the image forming apparatus shown in FIGS. 4A and 4B has basically the same configuration as that of the image forming apparatus shown in FIGS. 1 to 3.

As explained above, an guide control unit is provided that adjusts the recording-medium directing member together with a removal/mounting operation of the detachable unit so as to allow the recording-medium directing member 32 to occupy, when the open/close member 29 is opened to move the detachable unit formed of the waste toner container 28 from a predetermined mounting position inside the apparatus body 4, a covering position at which the front 38 of the image carrier formed of the intermediate transfer member 21 directed toward the opening 31 of the opened apparatus body 4 and so as to allow the recording-medium directing member 32 to occupy, when the detachable unit is accommodated inside the apparatus body 4 at a predetermined position, the recording-medium directing position separated from the covering position at which the front 38 of the image carrier is covered. With this, even if the user inserts his or her hand in the opening 31, the user is prevented from touching the surface of the image carrier.

As explained above, in place of actuating the recording-medium directing member 32 together with a removal/mounting operation of the detachable unit, it is possible to adjust the recording-medium directing member 32 between the recording-medium direction position and the covering position together with an opening/closing operation of the open/close member 29. A specific example of this is shown in FIG. 5.

Figure 5:
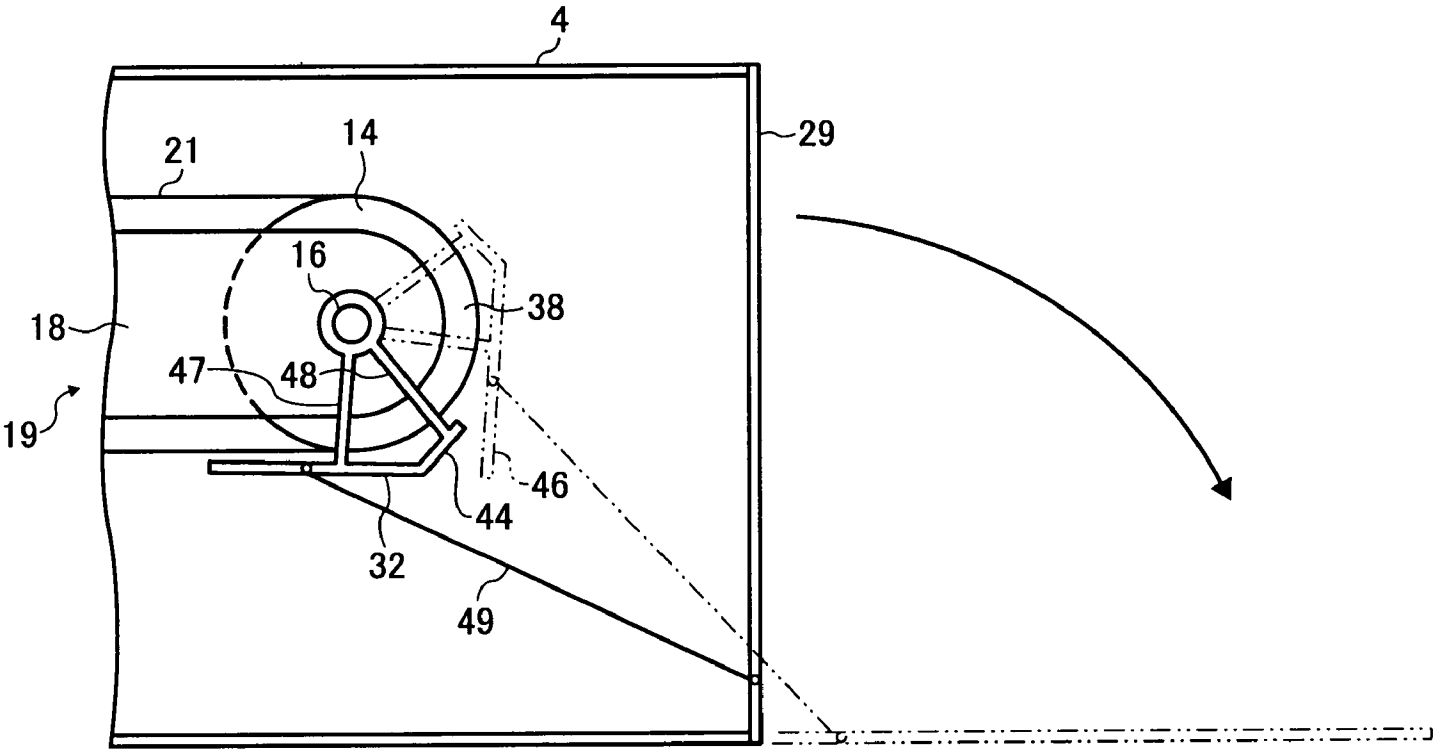
FIG. 5 is a schematic diagram for explaining the operation of a recording-medium directing member that is adjusted together with opening/closing of the open/close member.

In FIG. 5, the center shaft 16 of the supporting roller 14 has bases of arms 47 and 48 rotatably supported, and the recording-medium directing member 32 is fixed at the tips of both the arms 47 and 48. Also, ends of a connecting link 49 schematically shown in FIG. 5 in a longitudinal direction are pivotally attached to the recording-medium directing member 32 and the open/close member 29 for relative rotation.

When the open/close member 29 is closed as depicted with a solid line in FIG. 5, the recording-medium directing member 32 occupies the recording-medium directing position at which the recording medium can be directed by the recording-medium directing surface 44. At this time, the recording-medium directing member 32 is pressed by a stopper (not shown) provided to the frame 18, and is pressed and held in an immovable state with respect to the frame 18. When the open/close member 29 is opened as depicted with a two-dot chain line in FIG. 5, the recording-medium directing member 32 is pulled via the connection link 49 to the open/close member 29. Therefore, the recording-medium directing member 32 is rotated in a counterclockwise direction about the center shaft 16 to occupy a covering position indicated by two-dot chain lines, thereby covering the front 38 of the intermediate transfer member 21. With this, the user can be inhibited from touching the surface of the intermediate transfer member 21 by hand. Also in this case, the lower portion 46 of the recording-medium directing member 32 is positioned between the intermediate transfer member 21 and the waste toner container (refer to FIG. 1). Therefore, the waste toner container can be inhibited from making contact with the intermediate transfer member 21 when attached or detached. When the open/close member 29 is closed, the recording-medium directing member 32 is again returned to the recording-medium directing position indicated by the solid lines. Other than that, the configuration of the image forming apparatus shown in FIG. 5 is substantially identical to that of the image forming apparatus shown in FIGS. 1 to 3.

As explained above, an guide control unit is provided that adjusts the recording-medium directing member together with an opening/closing operation of the open/close member 29 so as to allow the recording-medium directing member 32 to occupy, when the open/close member 29 is opened, a covering position at which the front 38 of the image carrier directed toward the opening 31 of the opened apparatus body 4 is covered and so as to allow the recording-medium directing member 32 to occupy, when the open/close member is closed, a recording-medium directing position separated from the covering position at which the front 38 of the image carrier is covered. With this also, the user can be inhibited from touching the image carrier by inserting his or her hand in the opening.

Meanwhile, when the waste toner container 28 is accommodated inside the apparatus body 4 at a predetermined mounting position, the waste toner container 28 and the recording-medium guide member 37 have to be accurately positioned with respect to the apparatus body 4. Also, the recording-medium directing member 32 provided to the carrier unit 19 has to be accurately positioned with respect to the apparatus body 4. However, originally, the carrier unit 19 has been accurately positioned with respect to the apparatus body 4. Therefore, as in the image forming apparatus shown in FIGS. 1 to 5, when the waste toner container 28 is mounted inside the apparatus body 4, if the recording-medium directing member 32 is being fixed to the frame 18 of the carrier unit 19, the recording-medium directing member 32 is positioned with high accuracy with respect top the apparatus body 4.

Thus, as shown in FIG. 4A, when the waste toner container 28 is mounted inside the apparatus body 4, the recording-medium guide member 37 fixed to the waste toner container 28 is caused to abut on the recording-medium directing member 32, thereby accurately positioning both the recording-medium guide member 37 and the waste toner container 28 with respect to the apparatus body 4. If the recording-medium directing member 32 is integrally fixed and connected to the frame 18 of the carrier unit 19 as is the case of the image forming apparatus shown in FIG. 3, the recording-medium guide member 37 is caused to abut on the recording-medium directing member 32, thereby positioning the recording-medium guide member 37 and the waste toner container 28 with respect to the apparatus body 4 with higher accuracy. In this manner, with the detachable unit being mounted inside the apparatus body 4, the recording-medium guide member 37 is caused to abut on the recording-medium directing member 32, thereby positioning the detachable unit and the recording-medium guide member 37 with respect to the apparatus body 4. This can eliminate the need of a dedicated positioning unit for each of the detachable unit and the recording-medium guide member 37. Such a configuration can also be applied to the image forming apparatuses shown in FIGS. 3 and 5.

Figure 6:
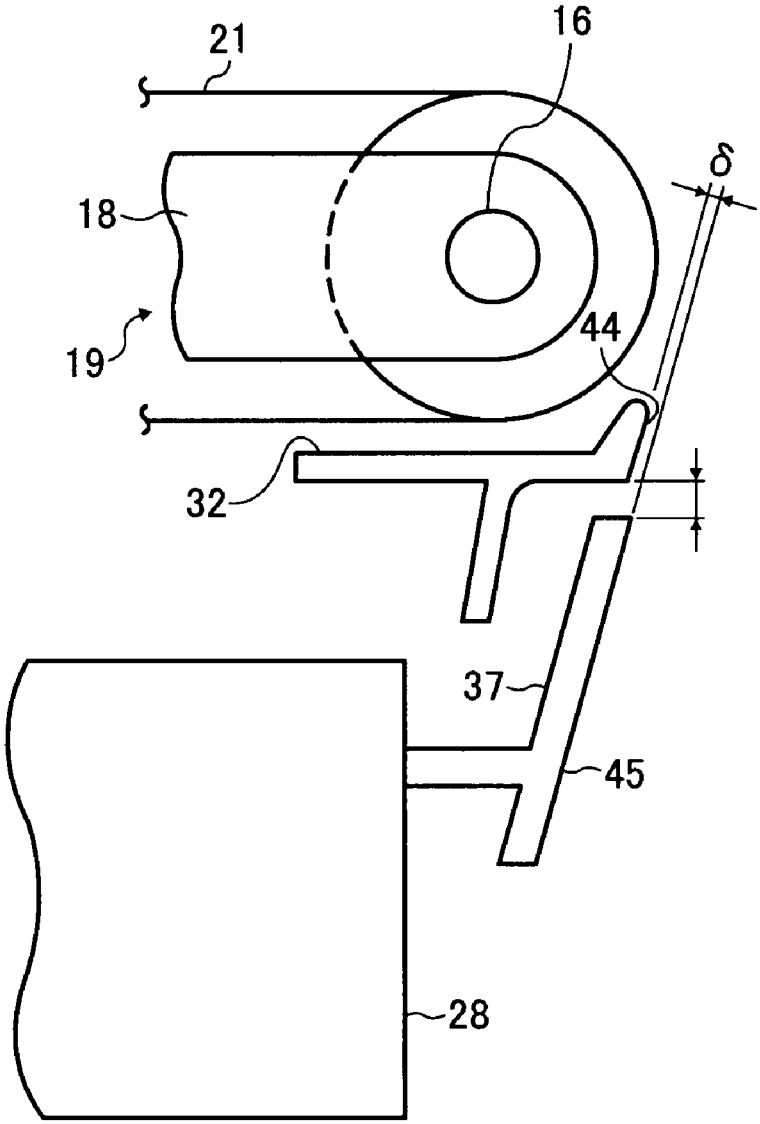
FIG. 6 is a schematic diagram of an example in which the recording-medium directing member and the recording-medium guide member are separated from each other.

In contrast to the case explained above, the detachable unit formed of the waste toner container 28 mounted inside the image forming apparatus can be positioned with respect to the apparatus body 4 by another unit other than the recording-medium directing member 32. In this case, however, if the recording-medium directing member 32 and the recording-medium guide member 37 are in contact with each other, the waste toner container 28 and the recording-medium guide member 37 may be deviated from each correct target position. To get around this, as shown in FIG. 6, a preferable configuration is such that the recording-medium directing member 32 and the recording-medium guide member 37 are separated from each other. With the waste toner container 28 being set inside the apparatus body 4, a preferable space δ formed between the recording-medium directing member 32 and the recording-medium guide member 37 is equal to or larger than 0.3 millimeters.

Also in the image forming apparatus shown in FIG. 6, the conveyed recording medium first makes contact with the recording-medium directing surface 45 of the recording-medium guide member 37, and then with the recording-medium directing surface 44 of the recording-medium directing member 32. At this time, if the recording-medium directing surface 44 of the recording-medium directing member 32 protrudes to the side of the conveyed recording medium from the recording-medium directing surface 45 of the recording-medium guide member 37, the recording medium may abut on the recording-medium directing member 32 to cause a trouble in conveying the recording medium. To get around this, as shown in FIG. 6, the recording-medium directing member 32 and the recording-medium guide member 37 are preferably disposed so that the recording-medium directing surface 44 of the recording-medium directing member 32 does not protrude to the side of the recording medium from the recording-medium directing surface 45 of the recording-medium guide member 37. The same goes for the case in which the recording-medium directing member and the recording-medium guide member are disposed so that the conveyed recording medium first makes contact with the recording-medium directing member 32 and then with the recording-medium guide member 37. The bottom line is that the recording-medium guide member and the recording-medium directing member are disposed so that one of the recording-medium directing surfaces of the recording-medium guide member and the recording-medium directing member with which the conveyed recording medium makes contact later does not protrude to the side of the conveyed recording medium from the recording-medium directing surface of the other member with which the recording medium makes contact first.

Also, as shown in FIGS. 3, 4A, and 4B, if the recording-medium guide member 37 can be used as a handle 50 held by the user with his or her hand when the detachable unit formed of the waste toner container 28 is attached or detached, an independent handle member can be omitted, resulting in less cost of the image forming apparatus.

In the above embodiment, the intermediate transfer member 21 formed of an endless belt serves as an image carrier and the waste toner container 28 serves as a detachable unit. However, the present invention is not so limited, and can be applied similarly to the cases, for example, where an optical writing unit or a sheet feeding device serves as a detachable unit.

According to an embodiment of the present invention, an increase in complexity of the configuration of the image forming apparatus and an increase in cost can be suppressed. Moreover, the detachable unit can be prevented from bumping against the image carrier.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a carrier unit that includes an image carrier that carries a toner image, and a frame that supports the image carrier;

a transferring unit that transfers the toner image from the image carrier onto a recording medium being conveyed in a conveying path past the image carrier; and a detachable unit that is detachably mounted on an apparatus body, and located near the image carrier, wherein the detachable unit does not include the image carrier and is able to be detached from the image forming apparatus by movement in a path that crosses the conveying path from a side of the conveying path that is the same side as the location of the image carrier to a side of the conveying path that is opposite the location of the image carrier, and wherein the carrier unit further includes a first guide member that guides the recording medium, and prevents the detachable unit from contacting the image carrier when the detachable unit is attached or detached.

2. The image forming apparatus according to claim 1, wherein the detachable unit includes a second guide member that is adjacent to the first guide member and located in the path of movement through which the detachable unit is attached and detached.

3. The image forming apparatus according to claim 1, further comprising:

an open and close member that is openably and closably supported on the apparatus body, and forms an opening when opened to allow the detachable unit to be attached or detached through the opening; and a guide control unit that adjusts the first guide member together with attachment and detachment of the detachable unit, wherein the guide control unit positions the first guide member at a first position where the first guide member covers a surface of the image carrier facing the opening when the detachable unit is detached from the apparatus body, and the guide control unit positions the first guide member at a second position separated from the first position when the detachable unit is attached to the apparatus body.

4. The image forming apparatus according to claim 1, further comprising:

an open and close member that is openably and closably supported on the apparatus body, and forms an opening when opened to allow the detachable unit to be attached or detached through the opening; and a guide control unit that adjusts the first guide member together with open and close movement of the detachable unit, wherein the guide control unit positions the first guide member at a first position where the first guide member covers a surface of the image carrier facing the opening when the open and close member is opened, and the guide control unit positions the first guide member at a second position separated from the first position when the open and close member is closed.

5. The image forming apparatus according to claim 2, wherein the second guide member contacts the first guide member when the detachable unit is attached to the apparatus body such that the detachable unit and the second guide member are positioned with respect to the apparatus body.

6. The image forming apparatus according to claim 3, wherein the second guide member contacts the first guide member when the detachable unit is attached to the apparatus body such that the detachable unit and the second guide member are positioned with respect to the apparatus body.

7. The image forming apparatus according to claim 4, wherein the second guide member contacts the first guide member when the detachable unit is attached to the apparatus body such that the detachable unit and the second guide member are positioned with respect to the apparatus body.

8. The image forming apparatus according to claim 2, wherein the detachable unit is positioned with respect to the apparatus body by a unit other than the first guide member, and the first guide member and the second guide member are separated from each other.

9. The image forming apparatus according to claim 3, wherein the detachable unit is positioned with respect to the apparatus body by a unit other than the first guide member, and the first guide member and the second guide member are separated from each other.

10. The image forming apparatus according to claim 4, wherein the detachable unit is positioned with respect to the apparatus body by a unit other than the first guide member, and the first guide member and the second guide member are separated from each other.

11. The image forming apparatus according to claim 2, wherein one of the second guide member and the first guide member includes a first guide surface that contacts the recording medium being conveyed, the other one of the second guide member and the first guide member includes a second guide surface that contacts the recording medium being conveyed after the first guide surface contacts the recording medium, and the second guide member and the first guide member are located such that the second guide surface does not protrude to a recording medium side from the first guide surface.

12. The image forming apparatus according to claim 3, wherein one of the second guide member and the first guide member includes a first guide surface that contacts the recording medium being conveyed, the other one of the second guide member and the first guide member includes a second guide surface that contacts the recording medium being conveyed after the first guide surface contacts the recording medium, and the second guide member and the first guide member are located such that the second guide surface does not protrude to a recording medium side from the first guide surface.

13. The image forming apparatus according to claim 4, wherein one of the second guide member and the first guide member includes a first guide surface that contacts the recording medium being conveyed, the other one of the second guide member and the first guide member includes a second guide surface that contacts the recording medium being conveyed after the first guide surface contacts the recording medium, and the second guide member and the first guide member are located such that the second guide surface does not protrude to a recording medium side from the first guide surface.

14. The image forming apparatus according to claim 2, wherein the second guide member serves as a handle to attach and detach the detachable unit.

15. The image forming apparatus according to claim 3, wherein the second guide member serves as a handle to attach and detach the detachable unit.

16. The image forming apparatus according to claim 4, wherein the second guide member serves as a handle to attach and detach the detachable unit.

17. An image forming apparatus comprising:

a carrier unit that includes an image carrier that carries a toner image, and a frame that supports the image carrier;

a transferring unit that transfers the toner image from the image carrier onto a recording medium; and a detachable unit that is detachably mounted on an apparatus body, and located near the image carrier, wherein the detachable unit does not include the image carrier, and wherein the carrier unit further includes a first guide member that guides the recording medium, and prevents the detachable unit from contacting the image carrier when the detachable unit is attached or detached, wherein the detachable unit is a waste toner container.

18. The image forming apparatus according to claim 2, wherein the second guide member includes a surface that guides the recording medium.

* * * * *